US011185973B1

(12) United States Patent
Fulbrook

(10) Patent No.: US 11,185,973 B1
(45) Date of Patent: Nov. 30, 2021

(54) TWO-SIDED CASING CHISEL AND METHOD OF USE

(71) Applicant: Efficiency Products, LLC, Fairfax, VA (US)

(72) Inventor: Jim E Fulbrook, Fairfax, VA (US)

(73) Assignee: Efficiency Product, LLC, Fairfax, VA (US)

( * ) Notice: Subject to any disclaimer, the term of this patent is extended or adjusted under 35 U.S.C. 154(b) by 0 days.

(21) Appl. No.: 16/922,272

(22) Filed: Jul. 7, 2020

Related U.S. Application Data

(60) Provisional application No. 62/947,572, filed on Dec. 13, 2019.

(51) Int. Cl.
*B25G 3/12* (2006.01)
*E04F 21/00* (2006.01)
*B25D 3/00* (2006.01)

(52) U.S. Cl.
CPC ..... *B25G 3/12* (2013.01); *B25D 3/00* (2013.01); *E04F 21/00* (2013.01)

(58) Field of Classification Search
CPC .. B25G 3/12; B25D 3/00; E04F 21/00; B23D 71/04; B23D 71/06; B23D 71/08; B24B 19/009
See application file for complete search history.

(56) References Cited

U.S. PATENT DOCUMENTS

| | | | | |
|---|---|---|---|---|
| 470,794 | A * | 3/1892 | Shempp | B24D 15/04 451/495 |
| 1,463,745 | A * | 7/1923 | Layne | B44D 3/162 30/171 |
| 3,165,832 | A * | 1/1965 | Stipcevich | B44D 3/168 30/140 |
| 4,668,248 | A * | 5/1987 | Dettelbach | B24D 13/12 451/542 |
| 6,182,317 | B1 * | 2/2001 | Huang | B25F 1/00 7/105 |
| 6,270,399 | B2 * | 8/2001 | Gunn | B27G 17/025 451/524 |
| 6,568,087 | B1 * | 5/2003 | Gringer | B23D 71/04 15/236.01 |
| 2012/0122379 | A1 * | 5/2012 | McDonell | E04F 19/02 451/442 |
| 2015/0026986 | A1 * | 1/2015 | Berglund | B23D 79/08 30/172 |

* cited by examiner

*Primary Examiner* — Joel D Crandall
(74) *Attorney, Agent, or Firm* — Invention to Patent Services; Alex Hobson

(57) ABSTRACT

A two-sided casing chisel has two chisel blades that are mirror images of each other to enable one tool for chiseling and cleaning the doorway casing on either side of the doorway. The two-sided tool simply has to be flipped around to allow cleaning of doorway casing on an opposing side of the doorway. The chisel blades may be coupled to a blade assembly that is detachably attachable to a handle assembly. The blade assembly may have a first end and second end each having a two-sided chisel blade or sanding ends with an abrasive material to allow sanding along a doorway casing. The blade assembly may be reversible to allow a user to flip the blade assembly upside down to expose second end which may have sanding ends for sanding or a second set of chisel blades in the event blades on the first end become dull.

15 Claims, 8 Drawing Sheets

TWO-SIDED CASING CHISEL AND METHOD OF USE

CROSS REFERENCE TO RELATED APPLICATIONS

This application claims the benefit of U.S. provisional patent application No. 62/947,572, filed on Dec. 13, 2019; the entirety of which is incorporated by reference herein.

BACKGROUND OF THE INVENTION

Field of the Invention

The invention relates to a two-sided, reversible doorway casing chisel having cutting blades that are mirror images of each other to enable quick cleaning of opposing sides of the vertical casing surrounding a doorway.

Background

Debris, paint, sealer, caulk, and the like can collect around the bottom of doorway casing or doorway molding, aka moulding, and is unattractive. Paint for example may run and pool or form bulging globs along the base of the doorway casing molding and the floor. This is difficult to clean and remove as doorway casing molding often has curved and recessed features. In addition, shoe molding may be placed around a doorway casing molding and to enable a proper fit, debris, caulk, paint drips and the like must be removed before installation of the doorway shoe molding.

SUMMARY OF THE INVENTION

The invention is directed to a doorway casing chisel that has a curved chisel surface that matches that of the doorway casing contours. Each interior doorway in a home usually consists of vertical casings mounted on each side of the doorway that is connected to the door jamb on the inside and the baseboard against the wall on the wall sides. In an exemplary embodiment, a two-sided casing chisel has two chisel blades that are mirror images of each other to enable one tool for cleaning the doorway casing on either side of the doorway. The two-sided tool is simply flipped around to allow cleaning of the doorway casing on an opposing side of the doorway.

In addition, the chisel blades may be detachably attached to a handle and may be reversed so that the opposite side of the blades at the contoured ends can be used as either a file or another pair of sharpened chisel blades when reattached to the handle. In other words, an exemplary casing chisel has two pairs of usable blades/files.

An exemplary two-sided casing chisel comprises two components: a handle onto which the chisel blades are attached and a pair of chisel blades that are mirror images of each other and reversible so that each contoured end is usable for chiseling or filing the contoured matched vertical doorway casing. Between a first and second chisel blade may be an H-shaped blade coupler that secures the two blades in place and may serve as a surface to abut with the handle where striking the top of the handle with a hammer or mallet imparts a chiseling effect on the blades when placed against the lower end of the casing.

The handle may have an impact end on the top to receive an impact from a hammer or mallet. A user may hold the handle and hit the impact end of the handle to chisel along a doorway casing. Two shields or covers may extend down from the handle and protect the user from being exposed to the opposite sharp ends of the two-sided chisel blade. Blade couplers may extend down from the cover or handle on each side and between the two chisel blades to couple the two-sided chisel blade to the handle and enable detachment and flipping the two-sided chisel blade upside down for re-attachment. The blade couplers may be metal extensions made of spring steel that act as spring elements that are forced outward as the two-sided chisel blade assembly is inserted up into the handle assembly, between the two shields. The blade couplers may have a coupler lock, such as a protrusion on an extended end, that snaps into a recess in the blade support. A user may pull the blade couplers out from the engagement with the blade support to detach the blade assembly from the handle assembly.

A cutting blade may have a curved contour to match that of a doorway casing. A cutting blade on a first side may be the mirror image of the cutting blade on the opposing second side. A user may place the first cutting blade along the first side of the doorway along the doorway casing and after chiseling off debris on the doorway casing on this first side, the tool can be flipped around and aligned so the second cutting blade can be placed against the casing on the opposing second side of the doorway to chisel off debris.

An exemplary two-sided casing chisel has a cutting blade that is contoured to match and interface with a casing, such as any of the commonly used 2.25-inch and 2.50-inch wide casing types depicted in FIG. 10 including, but not limited to, CM376, CM366, CM327, CM356, CM442, CM351, CM371, and any other industry standardized casings. For example, CM376 is 2.25 inches wide with multiple grooves and curves and is also commonly called "Colonial" style. It is currently the most frequently used standardized casing in the building industry and is produced by the majority of manufacturers of casings and moldings. The figures of chisel blades and casing depicted here are contour matched to the CM376 industry standard. In use, a builder may purchase a set of blades specific to the seven casing moldings listed above to insert into the handle, which is designed to secure each for use. Hence, one handle can be used for standardized casings that represent well over 95% of the doorway casings used in the US market today.

This application may be used in conjunction with a Shoe Moulding to Finish an Interior Doorway casing as described in PCT/US2019/013715 and U.S. Pat. No. 10,676,940 issued on Jun. 9, 2020, to Jim E Fulbrook, the entirety of which is hereby incorporated by reference herein. The invention may also be used independent of the doorway shoe moulding to chisel and sand the ends of the vertical casing to remove excess paint and debris in order to improve the doorway appearance and prepare the casing for painting.

The curved cutting and/or sanding ends of the first side and second side chisel blades are defined as being a non-linear shape and having one or more curved surfaces and in most cases a plurality of curved portions.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
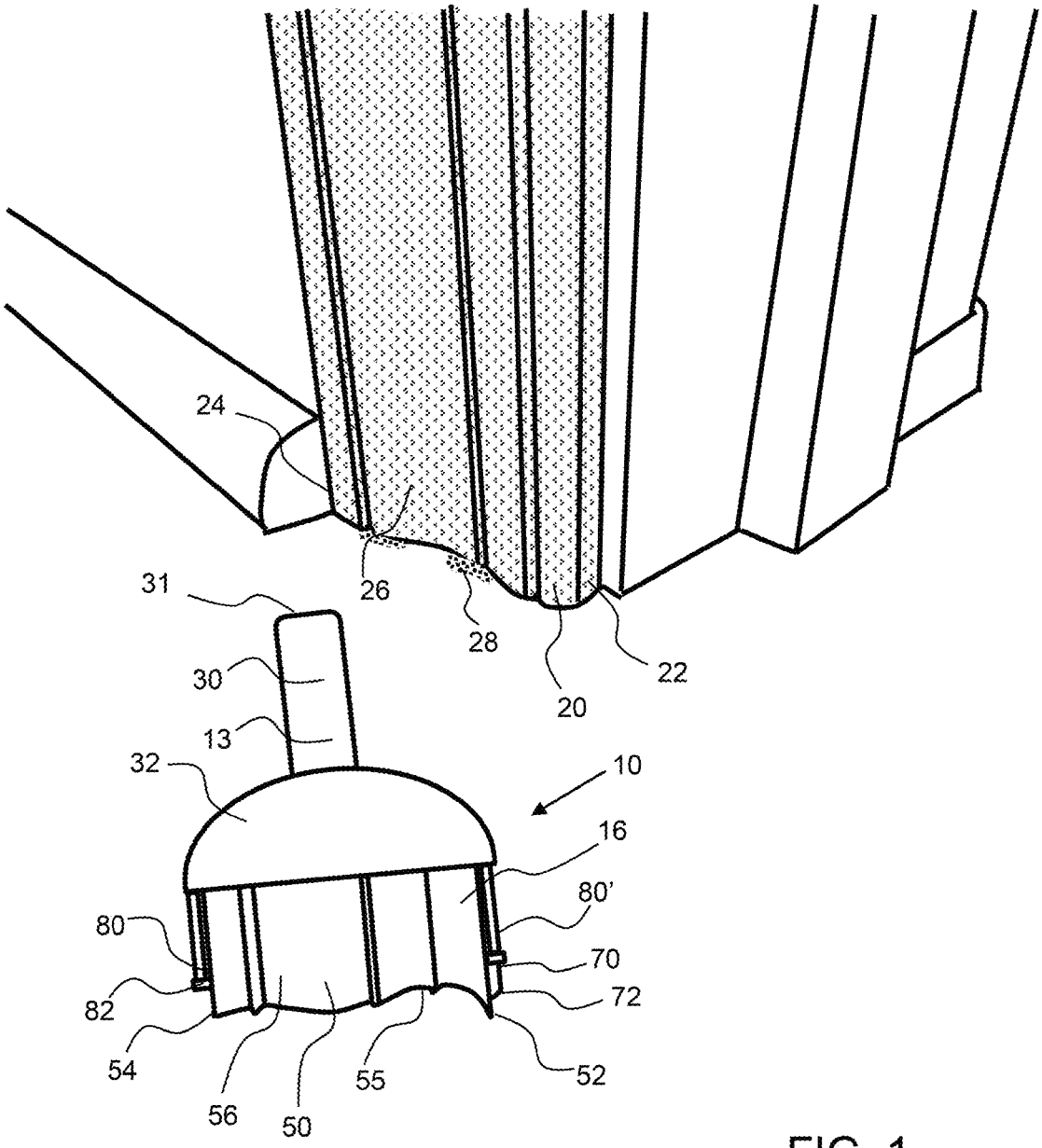
FIG. 1 shows an exemplary two-sided casing chisel having a first side chisel blade and an opposing second side chisel blade; wherein the casing chisel blade is contour matched to chisel the doorway casing shown (CM376 industry standard style).

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary two-sided casing chisel 10 has a blade assembly 16 coupled to a handle assembly 13 by the blade coupler springs 80, 80'. The blade assembly has a first side chisel blade 50 and an opposing second side chisel blade 70; wherein the casing chisel blade 70 is oriented to chisel the doorway casing 20 shown. The doorway casing extends from a doorway edge 22 to an extended edge 24 and has a curved outer surface 26. Paint 28 often collects along the base of the casing and is not appealing. The exemplary two-sided casing chisel 10 has the second side chisel blade 70 facing the casing and the second side chisel blade is a mirror image of the first side chisel blade 50 shown. The second side chisel blade has a doorway edge 72 that corresponds with the doorway edge 22 of the casing and an extended edge that corresponds with the extended edge 24 of the casing. The curved outer surface from the doorway edge to the extended edge of the second side chisel blade 70 corresponds with the curved outer surface 26 of the casing. The handle 30 has a coupled end, and an impact end 31, configured to be hit with a hammer or mallet to chisel the doorway casing. The first side chisel blade 50 is a mirror image of the second side chisel blade and has a curved outer surface 56 that extends from a doorway edge 52 to an extended edge 54. The cutting end 55 may be sharp to enable chiseling off the paint or debris from the doorway casing.

Figure 2:
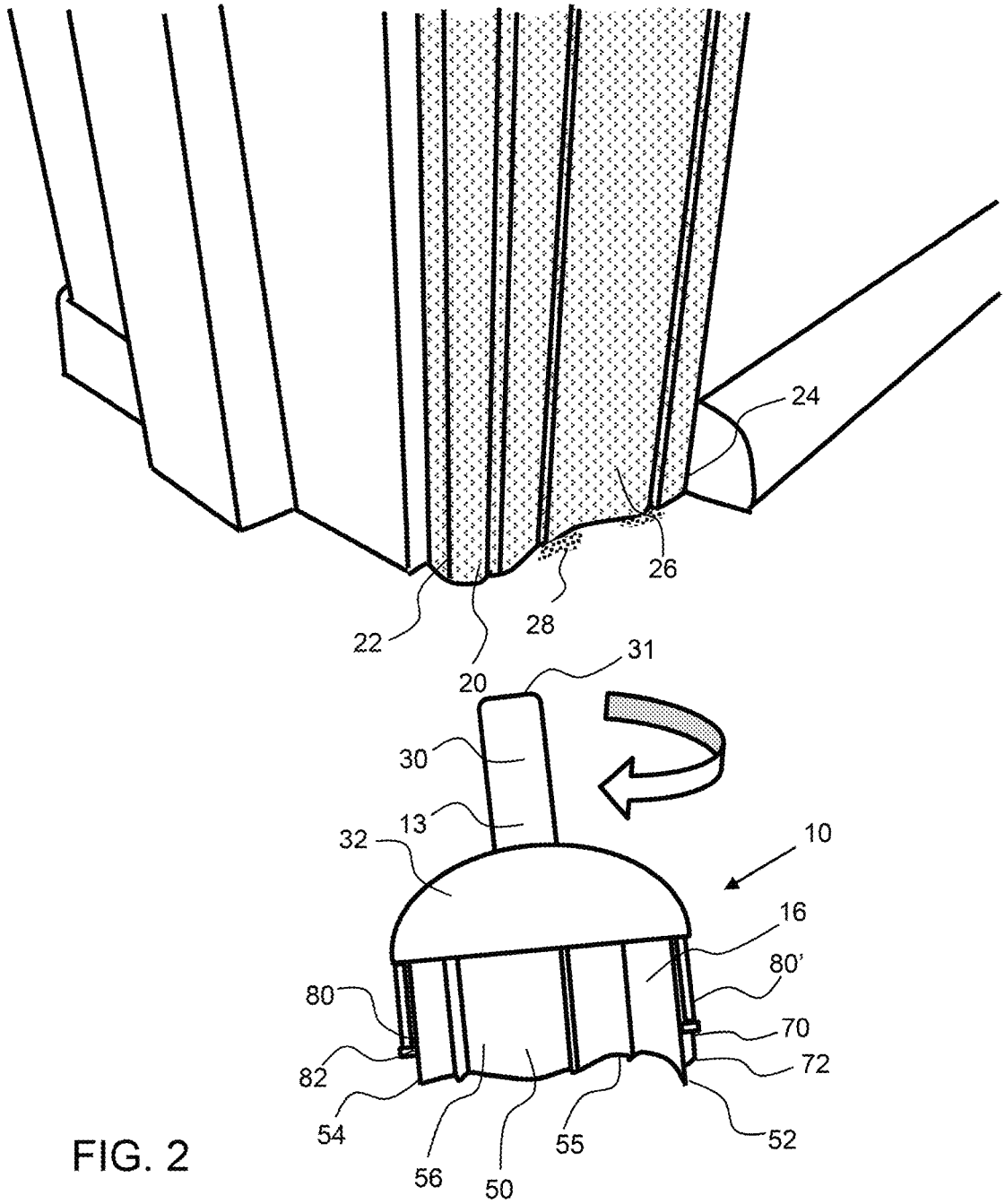
FIG. 2 shows an exemplary two-sided casing chisel having a first side chisel blade and an opposing second side chisel blade; wherein the two-sided casing chisel is rotated 180 degrees to orient the second side chisel blade to the doorway casing shown.

As shown in FIG. 2, the exemplary two-sided casing chisel 10 shown in FIG. 1, is now configured in front of the opposing side of the doorway. In order to chisel the opposing casing 22, the two-sided casing chisel 10 must be rotated 180 degrees to present the first side chisel blade to the casing, as indicated by the bold curved arrow. The first side chisel blade 50 corresponds with the casing as shown to enable chiseling off debris along the bottom of the casing. The first side chisel blade has a curved outer surface 56 that matches the curved outer surface 26 of the casing. The first side chisel blade has a doorway edge 52 that corresponds with the doorway edge 22 of the casing and an extended edge 54 that corresponds with the extended edge 24 of the casing. The curved outer surface from the doorway edge to the extended edge of the first side chisel blade 50 corresponds with the curved outer surface 26 of the casing. In effect, the invention conveniently allows for the chiseling of all doorway casings one after the other on opposing sides in a single tool.

Figure 3:
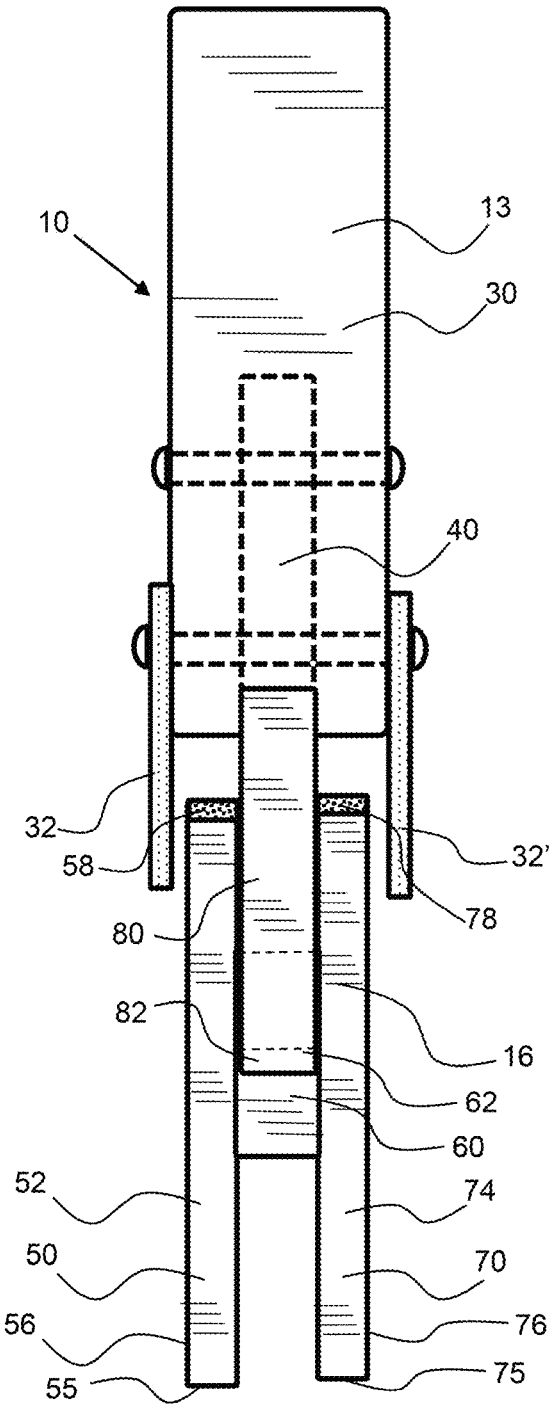
FIGS. 3 and 4 show side views of an exemplary two-sided casing chisel having a two-sided chisel blade consisting of a first side chisel blade and a second side chisel blade, wherein the chisel blades having cutting ends that are mirror images of each other.
Figure 4:
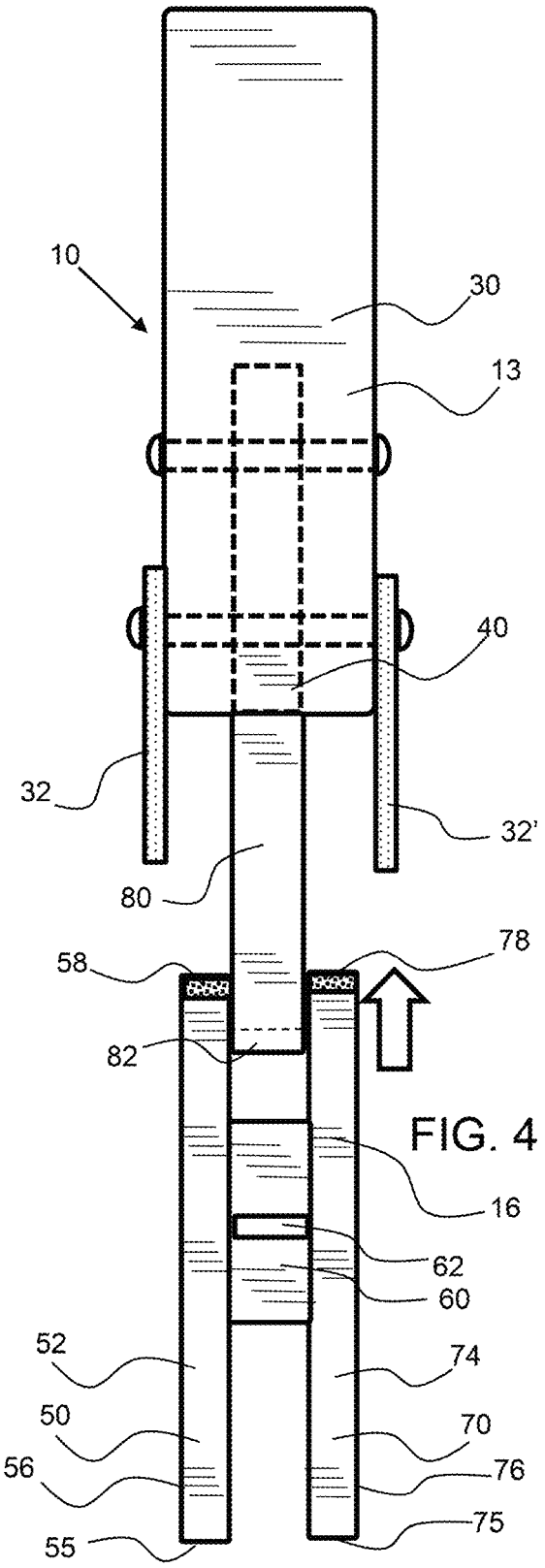
Figure 5:
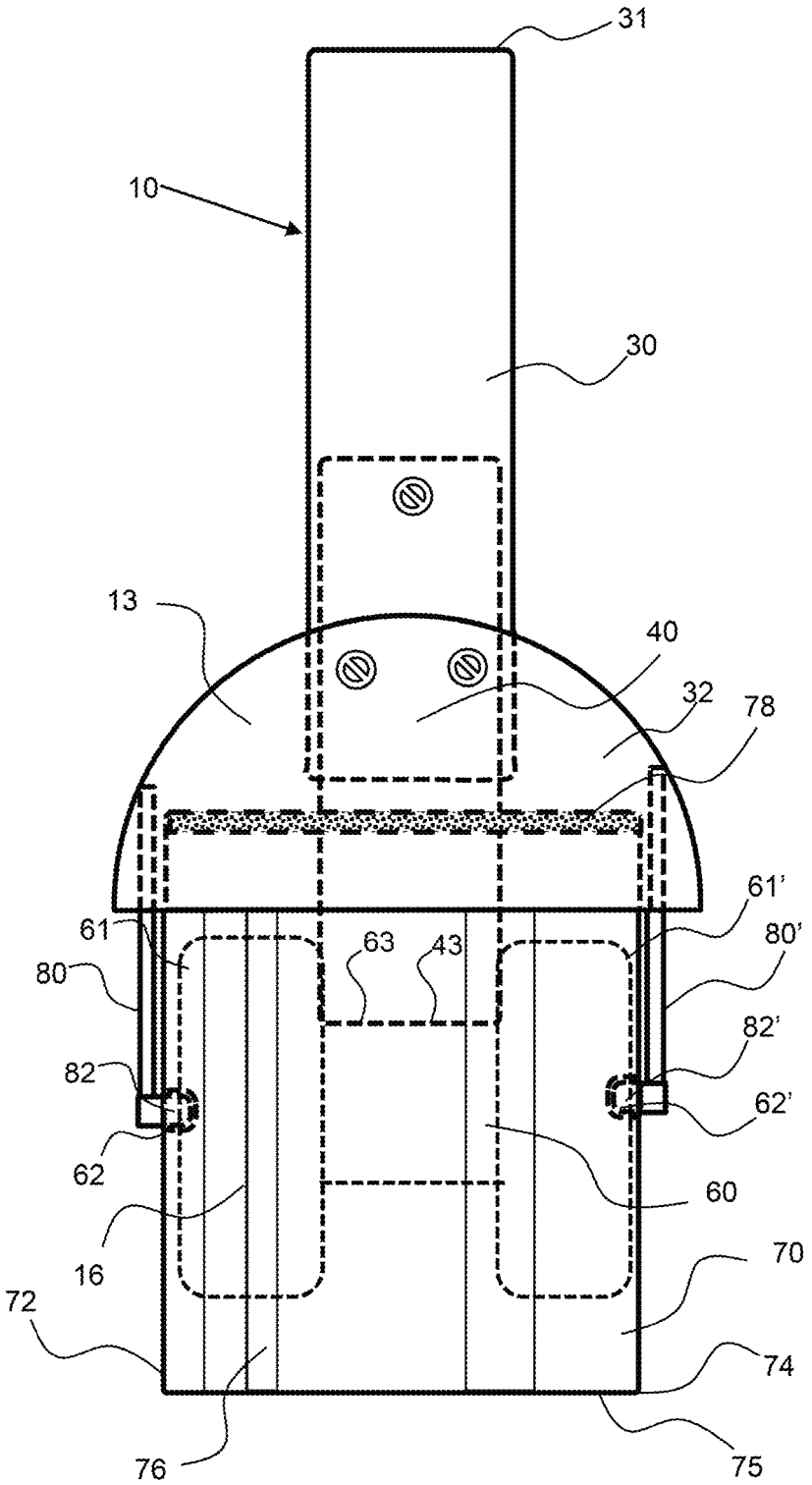
FIG. 5 shows a first side view of an exemplary two-sided casing chisel having a handle assembly coupled to a blade assembly.
Figure 6:
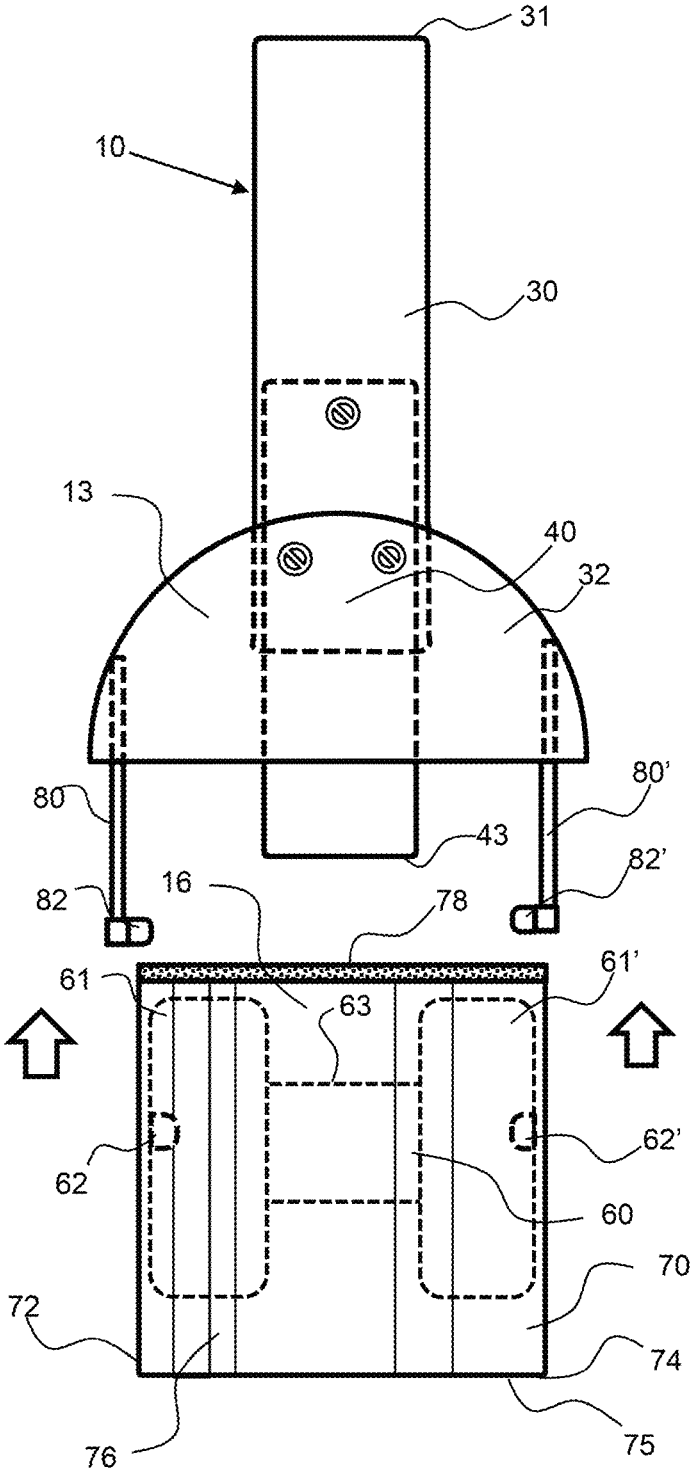
FIG. 6 shows a first side view of the exemplary two-sided casing chisel shown in FIG. 5, with the blade assembly detached from the handle assembly.

As shown in FIGS. 3 to 6, an exemplary two-sided casing chisel 10 has a blade assembly 16 that is detachably attachable to a handle assembly 13. As shown in FIG. 3, the blade assembly is attached to the handle assembly by the blade couplers 80, 80' that extend down between the two blades 50, 70 of the blade assembly and couple with the blade support 60, a support member extending between the two blades. The blade support 60 has coupler attachment recesses 62, 62' configured to receive the coupler locks 82, 82', protrusions extending from the blade couplers 80, 80'. The coupler locks 82, 82' may snap into the coupler attachment recesses 62, 62' to secure the blade assembly to the handle assembly as shown in FIGS. 3 and 5. As shown in FIGS. 4 and 6, the blade assembly is detached from the handle assembly.

Figure 8:
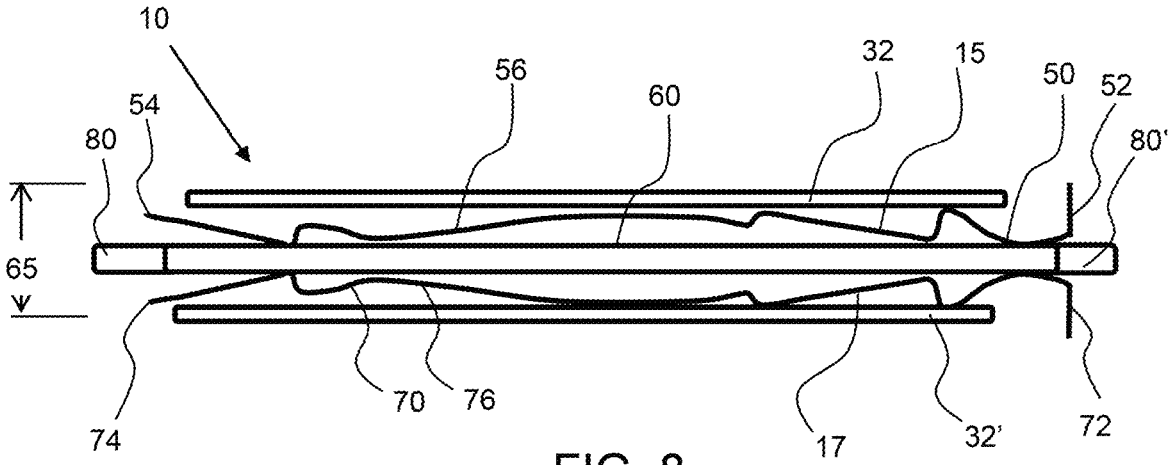
FIG. 8 shows a bottom view of an exemplary two-sided casing chisel configured for the standard CM376 casing shown in FIG. 7.

The blade assembly 16 comprises a first side chisel blade 50 and a second side chisel blade 70 coupled together by a blade support 60, which may be an H-shaped support element as shown in FIGS. 5 and 6. The blade support may have a receiving aperture 63 for receiving the shaft end 43 of the shaft 40 and coupler attachment recesses 62, 62' for receiving the coupler locks 82, 82', respectively, as best shown in FIG. 6. The shaft 40 may be an extension of the handle 30 or a separate piece that is coupled to the handle. As best shown in FIG. 8, the blade assembly includes a first side chisel blade 50 and a second side chisel blade 70, wherein the chisel blades have cutting ends 55, 75 and curved outer surfaces 56, 76, respectively, along the cutting ends that are mirror images of each other.

FIG. 2 shows the doorway cutting edge 52, of the first side chisel blade and the extended edge 74 of the second side chisel blade is shown in FIGS. 5 and 6. An exemplary chisel blade may have cutting ends on either end or may have curved sanding ends 58, 78, opposing the cutting ends, or optionally a first curved cutting end and a second curved cutting end 55',75' that enable the blades to be flipped when the first curved cutting end becomes worn. The sanding ends may comprise an abrasive material to enable a user to sand along a doorway casing or the metal chisel blades may be etched with angled parallel cuts that create a filing end. The blade assembly may be simply flipped upside down and attached to the handle assembly for this purpose. As shown in FIG. 3 the blade coupler 80 extends between the two opposing chisel blades 50 and 70 and the coupler lock 82 is retained in the coupler attachment recess 62. As shown in FIGS. 4 and 6, the blade assembly 16 is detached from the handle assembly 13. As shown in FIG. 6, the blade support 60 has curved upper surfaces 61, 61' to enable the shaft end 43 and coupler locks 82, 82' to slide into the blade assembly 16 and lock into the recesses 62, 62' to secure the blade to the handle.

A handle assembly 13 comprises a handle 30 having an impact end 31 to receive an impact from a hammer or mallet to enable chiseling along a doorway casing. A shaft 40 extends from the handle and may be a separate piece that is attached to the handle. The shaft end 43 is configured to abut the blade support 60 at 63 to exert the chisel load to the blade assembly. Shields 32, 32' extend down from the handle to cover the inserted end of the blades 50, 70, for safety as they protect the user from being exposed to the sharp opposite ends of the blades. Blade couplers 80, 80' extend down from the handle assembly and have coupler locks 82, 82', respectively that are configured to be retained by the blade support 60. As best shown in FIG. 6, the blade support is configured with coupler attachment recesses 62, 62' for receiving and retaining the coupler locks 82, 82'.

Figure 7:
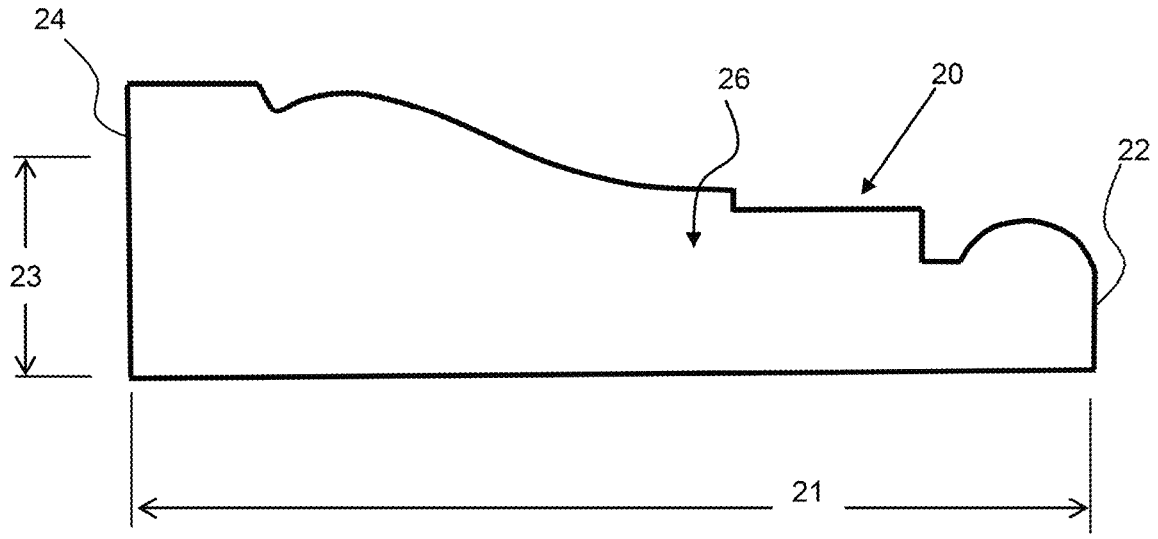
FIG. 7 shows a cross sectional view of a standard CM376 casing having a doorway edge and an extended edge.

As shown in FIG. 7, a standard CM376 casing 20 has a curved outer surface 26 that extends from a doorway edge 22 that joins the door jamb and an extended edge 24 that abuts with the wall baseboard. The vertical casing may be used along the opening of a doorway. This doorway casing may have a width 21 of about 2.25 inches and a depth 23 of about 9/16 inch or 11/16 inch.

Figure 9:
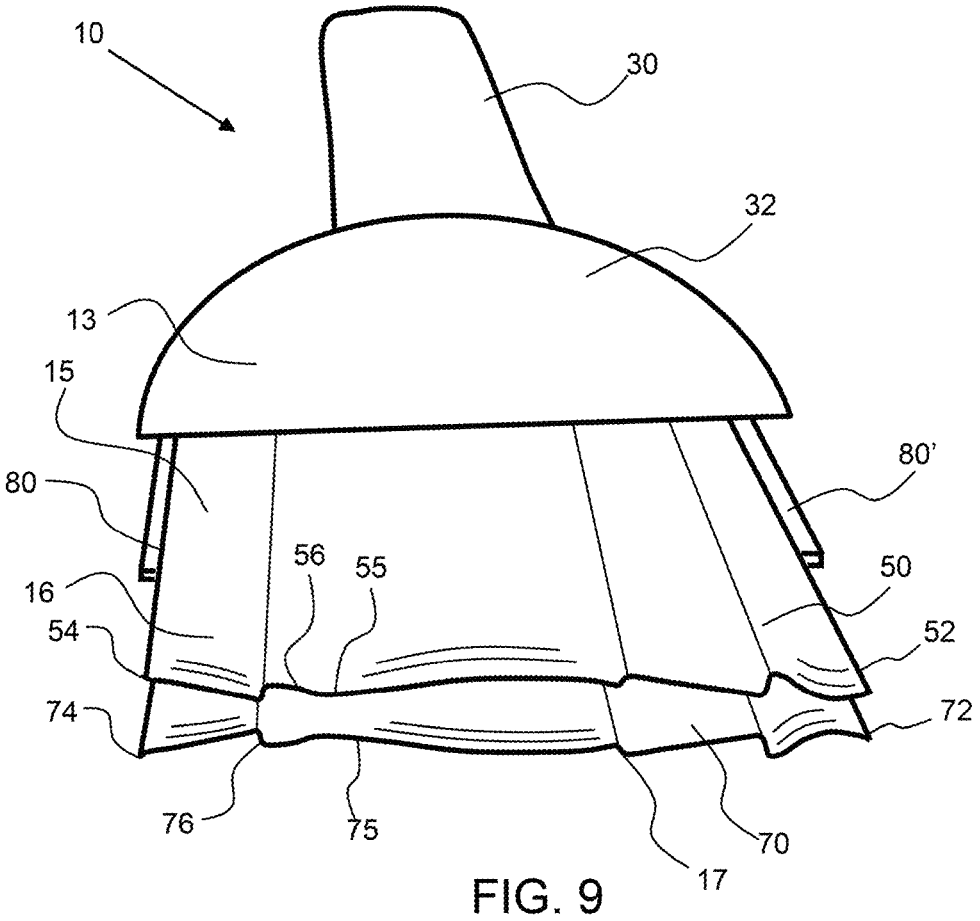
FIG. 9 shows a perspective view of an exemplary two-sided casing chisel configured for the standard CM376 casing shown in FIG. 7.

Referring now to FIGS. 8 and 9, an exemplary two-sided casing chisel 10 is configured for the standard CM376 casing shown in FIG. 7. The two-sided casing chisel has two curved chisel blades 50 and 70 that are configured as mirror images to each other. A first side chisel blade 50 is configured on a first side 15 of the two-sided casing chisel and a second side chisel blade 70 is configured on a second side 17 of the two-sided casing chisel 10. The first side chisel blade 50 has a curved outer surface 56 extending from a doorway edge 52 and an extended edge 54. Likewise, the second side chisel blade 70 has curved outer surface 76 extending from a doorway edge 72 and an extended edge 74. Again, the two curved chisel blades are configured as mirror images to conveniently enable spinning the two-sided casing chisel around to chisel along the casing on opposing sides of a doorway in a single tool. The depth 65 of the exemplary two-sided casing chisel 10 may be small, to prevent any marks made on the floor from being exposed after the addition of a doorway shoe moulding around the casing and door jamb (see U.S. Pat. No. 10,676,940) or when no doorway shoe moulding is used. The shields 32, 32' and handle 30 are shown in FIGS. 8 and 9.

Figure 10:
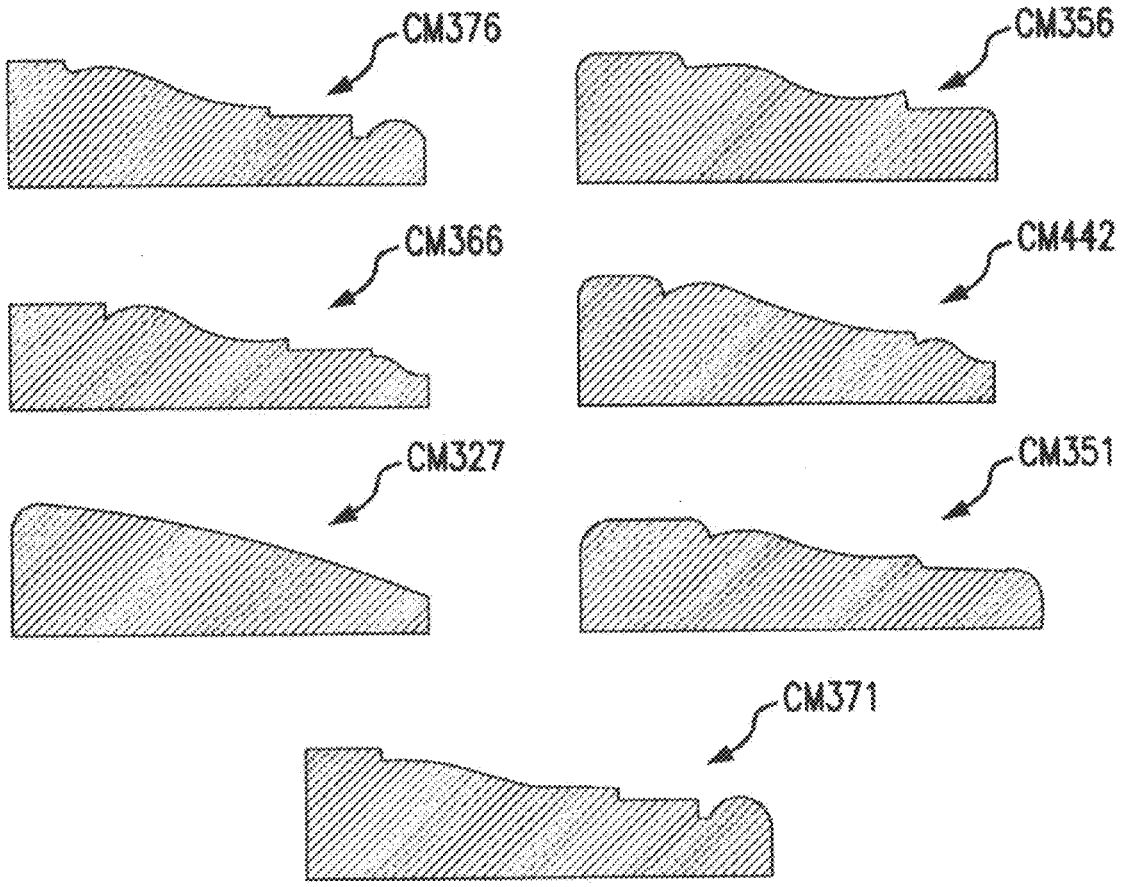
FIG. 10 shows cross-sections of seven exemplary standard casing profiles with a width of either 2.25 inches or 2.5 inches.

FIG. 10 shows cross-sections of seven exemplary standard casing profiles. Each of these casings have a curved outer surface that has a plurality of interconnected curved sections. The casings are either 2.25 inches or 2.5 inches in width and may be either 9/16 inch or 11/16 inch in height on the baseboard ends 52, 72. These casings represent about 95% of the current casing market in the U.S. The shields 32, 32' are designed with a width greater than 2.5 inches to protect the user from being exposed to the sharp ends of the blades. Wider casings than 2.5 inches are available in the market, which may be available by special order to purchase, but a wider blade shield on the handle will be required for user safety of the casing chisel.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A two-sided casing chisel comprising:

a) a first side and an opposing second side;

b) a handle assembly comprising:

i) a handle;

ii) a first blade coupler; and iii) a second blade coupler;

c) a blade assembly comprising:

i) a first side chisel blade configured on said first side and comprising:

a doorway edge;

an extended edge;

a first curved cutting end that extends from the doorway edge to the extended edge;

a curved contour extending from said cutting end to a second end, opposite said cutting end of said first chisel blade;

wherein the curved cutting end of the first side chisel blade has said curved contour that is a non-linear shape from the doorway edge to the extended edge that is contour matched to a casing;

ii) a second side chisel blade configured on said second side and comprising:

a doorway edge;

an extended edge;

a first curved cutting end that extends from the doorway edge of the second side chisel blade to the extended edge of the second side chisel blade;

a curved contour extending from said cutting end to a second end, opposite said cutting end of said second chisel blade wherein the curved cutting end of the second side chisel blade has said curved contour that is a non-linear shape from the doorway edge to the extended edge that is contour matched to said casing;

wherein the curved contour of the curved cutting end of the second side chisel blade is a mirror curved contour of the curved cutting end of the first side chisel blade; and iii) a blade support that is configured between and couples the first and second side chisel blades;

wherein both the first side chisel blade and the second side chisel blade are attached to and extend from the blade support to the respective cutting edge;

wherein the first blade coupler extends between the first side chisel blade and the second side chisel blade on a doorway edge side of the blade support and the second blade coupler extends between the first side chisel blade and the second side chisel blade on an extended edge side of the blade support, wherein said first blade coupler and second blade coupler each comprise a blade coupler lock configured to detachably attach the handle assembly with the blade assembly;

wherein the blade assembly is detachably attachable to the handle assembly; and wherein the handle extends in alignment with the first chisel blade and the second chisel blade.

2. The two-sided casing chisel of claim 1, further comprising a shaft that extends down from the handle assembly to a shaft end, wherein the shaft end is configured to extend between the first side and second side chisel blades.

3. The two-sided casing chisel of claim 2, wherein the shaft is an extension of the handle.

4. The two-sided casing chisel of claim 1, wherein the blade support comprises a receiving aperture for receiving the shaft end of the shaft.

5. The two-sided casing chisel of claim 4, wherein the first blade coupler lock and the second blade coupler lock each are a protrusion from the respective blade coupler and configured to detachably attach the handle assembly with the blade assembly.

6. The two-sided casing chisel of claim 5, wherein the blade support comprises a first coupler attachment recess and a second coupler attachment recess for receiving and retaining the first blade coupler and the second blade coupler, respectively.

7. The two-sided casing chisel of claim 1, wherein the first second curved cutting end, side chisel blade has the first curved cutting end and a second curved cutting end, opposite said first curved cutting end, wherein the second side chisel blade has the first curved cutting end of the second side chisel blade and a second curved cutting end, opposite said first curved cutting end of the second side chisel blade;

wherein the blade assembly is configured for attachment to the handle assembly with either the first curved cutting ends of the first side chisel blade and second side chisel blade or second curved cutting ends of the first side chisel blade and second side chisel blade extending from the handle.

8. The two-sided casing chisel of claim 7, further comprising a first shield that extends down from the handle and covers the second curved cutting end of the first side chisel blade and a second shield that extends down from the handle and covers the second curved cutting end of the second side chisel blade.

9. The two-sided casing chisel of claim 1, wherein the first side chisel blade has the first cutting end and a second curved sanding end opposite said first curved cutting end and wherein the second side chisel blade has the first curved cutting end and a second curved sanding end opposite said first curved cutting end of said second side chisel blade; wherein the blade assembly is configured for attachment to the handle assembly with either the curved cutting ends of the first side chisel blade and the second side chisel blade or curved sanding ends of the first side chisel blade and the second side chisel blade extending from the handle.

10. A method of chiseling doorway casing comprising:

a) providing the two-sided casing chisel of claim 1:

b) orienting the first side chisel blade against a bottom portion of a first doorway casing on a first side of a doorway;

wherein said doorway casing on said first side has said curved contour;

c) hammering the impact end of the handle to chisel said bottom portion of said first doorway casing;

d) orienting the second side chisel blade against a bottom portion of a second doorway casing on a second side of said doorway;

wherein said doorway casing on said second side has said mirrored curved contour from said curved contour of said doorway casing on said first side; and e) hammering the impact end of the handle to chisel said bottom portion of said second doorway casing.

11. The method of claim 10, comprising a shaft that extends down from the handle assembly to a shaft end, wherein the shaft end is configured to extend between the first side and second side chisel blades.

12. The method of claim 11, wherein the shaft is an extension of the handle.

13. The method of claim 10, further comprising a first shield that extends down from the handle and covers the curved cutting end of the first side chisel blade and a second shield that extends down from the handle and covers the curved cutting end of the second side chisel blade.

14. The method of claim 10, wherein the first side chisel blade has the first curved cutting end and a second curved cutting end opposite said first curved cutting end of said first side chisel blade and wherein the second side chisel blade has the first curved cutting end and a second curved cutting end opposite said first curved cutting end of said second side chisel blade; wherein the blade assembly is configured for attachment to the handle assembly with either the first curved cutting ends of the first side chisel blade and the second side chisel blade or second curved cutting ends of the first side chisel blade and the second side chisel blade extending from the handle.

15. The method of claim 10, wherein the first side chisel blade has the first cutting end and a second curved sanding end opposite said first curved cutting end of the first side chisel blade and wherein the second side chisel blade has the first curved cutting end and a second curved sanding end opposite said first curved cutting end of said second side chisel blade; wherein the blade assembly is configured for attachment to the handle assembly with either the curved cutting ends of the first side chisel blade and the second side chisel blade or curved sanding ends of the first side chisel blade and the second side chisel blade extending from the handle.

* * * * *